US005113774A

United States Patent [19]

Dusch et al.

[11] Patent Number: 5,113,774

[45] Date of Patent: May 19, 1992

[54] THREAD CUTTING DEVICE ON A SEWING MACHINE

[75] Inventors: Albert Dusch, Kaiserslautern; Karl-Heinz Walter, Weilerbach, both of Fed. Rep. of Germany

[73] Assignee: Pfaff Industriemaschinen GmbH, Kaiserslautern, Fed. Rep. of Germany

[21] Appl. No.: 499,265

[22] PCT Filed: Apr. 26, 1989

[86] PCT No.: PCT/EP89/00452

§ 371 Date: May 31, 1990

§ 102(e) Date: May 31, 1990

[87] PCT Pub. No.: WO89/12129

PCT Pub. Date: Dec. 14, 1989

[30] Foreign Application Priority Data

Jun. 6, 1988 [DE] Fed. Rep. of Germany ..... 3819135

[51] Int. Cl.[5] ..... D05B 65/00; D05B 47/00

[52] U.S. Cl. ..... 112/292; 112/254

[58] Field of Search ..... 112/292, 285, 291, 298, 112/295, 254, 229, 233

[56] References Cited

U.S. PATENT DOCUMENTS

| | | | |
|---|---|---|---|
| 3,141,432 | 7/1964 | Reeber et al. | 112/292 |
| 3,173,392 | 3/1965 | Hedegaard | 112/292 |
| 3,386,402 | 6/1968 | Ross | 112/292 |
| 4,254,725 | 3/1981 | Hager et al. | 112/292 |
| 4,365,568 | 12/1982 | Ross | 112/291 |
| 4,455,957 | 6/1984 | Vollmar | 112/292 |
| 4,471,707 | 9/1984 | Astrupgaard | 112/292 |
| 4,611,547 | 9/1986 | Kuramato | 112/254 |
| 4,694,765 | 9/1987 | Diehl | 112/254 |

FOREIGN PATENT DOCUMENTS

| | | |
|---|---|---|
| 2325564 | 1/1974 | Fed. Rep. of Germany . |
| 3529369 | 11/1986 | Fed. Rep. of Germany . |

*Primary Examiner*—Werner H. Schroeder
*Assistant Examiner*—Paul C. Lewis
*Attorney, Agent, or Firm*—McGlew & Tuttle

[57] ABSTRACT

A thread cutting arrangement for sewing machines including an arrangement in which the tension of the thread is released in both directions of movement of an axially moveable drive mechanism such that the thread tensioning mechanism is opened when the needle thread is caught. The movement of the drive mechanism is transmitted via a one-way coupling so that the opening of the thread tensioning mechanism is limited to the duration of the after pawal of the needle thread.

3 Claims, 3 Drawing Sheets

THREAD CUTTING DEVICE ON A SEWING MACHINE

FIELD OF THE INVENTION

The present invention pertains to a thread cutting device for sewing machines with a thread catcher. The thread catcher being actuated by an axially moveable drive mechanism to perform a first movement step catching the needle thread and the shuttle thread, and a second movement step whose direction is opposite to the first movement step in which the threads are pulled out and fed to a stationary cutting blade. A thread tensioning mechanism is provided for the needle thread and a releasing member for opening the thread tensioning mechanism during the thread pull operation. The releasing member being actuated by a cam rigidly attached to the drive mechanism.

BACKGROUND OF THE INVENTION

A thread cutting device, in which an axially displaceable drive mechanism catches the needle thread and the shuttle thread in one of its directions of movement and pulls them out and feeds them to the cutting blade in its other direction of movement, has become known from a realized sewing machine design. To control the releasing mechanism for the thread tension, a cam actuating the release mechanism is fastened on the drive mechanism. Even though this measure ensures a very simple drive of the tensioning mechanism, it causes opening of the thread tensioning mechanism during the movement of the drive mechanism in both directions of movement. This leads to difficulties in catching the loop under critical thread conditions and also to unequal thread ends after the cutting process.

SUMMARY AND OBJECTS OF THE INVENTION

It is an object of the present invention to design the releasing mechanism for thread tensioning in a thread cutting device with a thread catcher actuated by an auxiliary moveable drive mechanism which performs a first movement step catching the needle thread and the shuttle thread and a second movement step whose direction is opposite to the first movement step wherein the threads are pulled out and fed to a stationary cutting blade. A thread tensioning mechanism is provided for the needle thread and a releasing member for opening the thread tensioning mechanism during the thread pull operation. The releasing member being actuated by a cam rigidly attached to the drive mechanism so that the thread tensioning mechanism is opened only during the afterpull of the needle thread.

According to the invention, a thread cutting device is provided for sewing machines with a thread catcher. The thread cutting device being actuated by an axially moveable drive mechanism. The thread catcher performs a first movement step catching the needle thread and the shuttle thread and a second movement step whose direction is opposite to that of the first movement step in which the threads are pulled out and fed to a stationary cutting blade. A thread tensioning mechanism is provided for the needle thread and a releasing member is provided opening the thread tensioning mechanism during the thread pull operation. The releasing member can be actuated by a cam rigidly attached to the drive mechanism. A one way coupling is provided for the releasing member which is in action during the second movement step of the drive mechanism, the one way coupling being provided between the drive mechanism and a linkage connected to the releasing member.

With the control according to the present invention, the thread tensioning mechanism now remains closed during the penetration of the thread catcher into the needle thread loop, so that the stability of the loop is preserved when it is being caught by the thread catcher. The thread tensioning mechanism is opened only at the beginning of the afterpull of the needle thread and closes only when no more thread is pulled.

An embodiment of simple design of the one-way coupling is provided according to the invention in which the one-way coupling has a lever yielding in one direction. The lever pivoting during the first movement step of the drive mechanism and remaining rigid during the second movement step of the drive mechanism.

The measure according to the invention in which the cam is limited by a cam section rising in a wedge shaped manner at one end and by a radially dropping cam section at the other end leads to slip-free opening of the thread tensioning mechanism and to immediate closing of the thread tensioning mechanism after a sufficient amount of needle thread has been pulled in.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figures 1, 1A, 6:
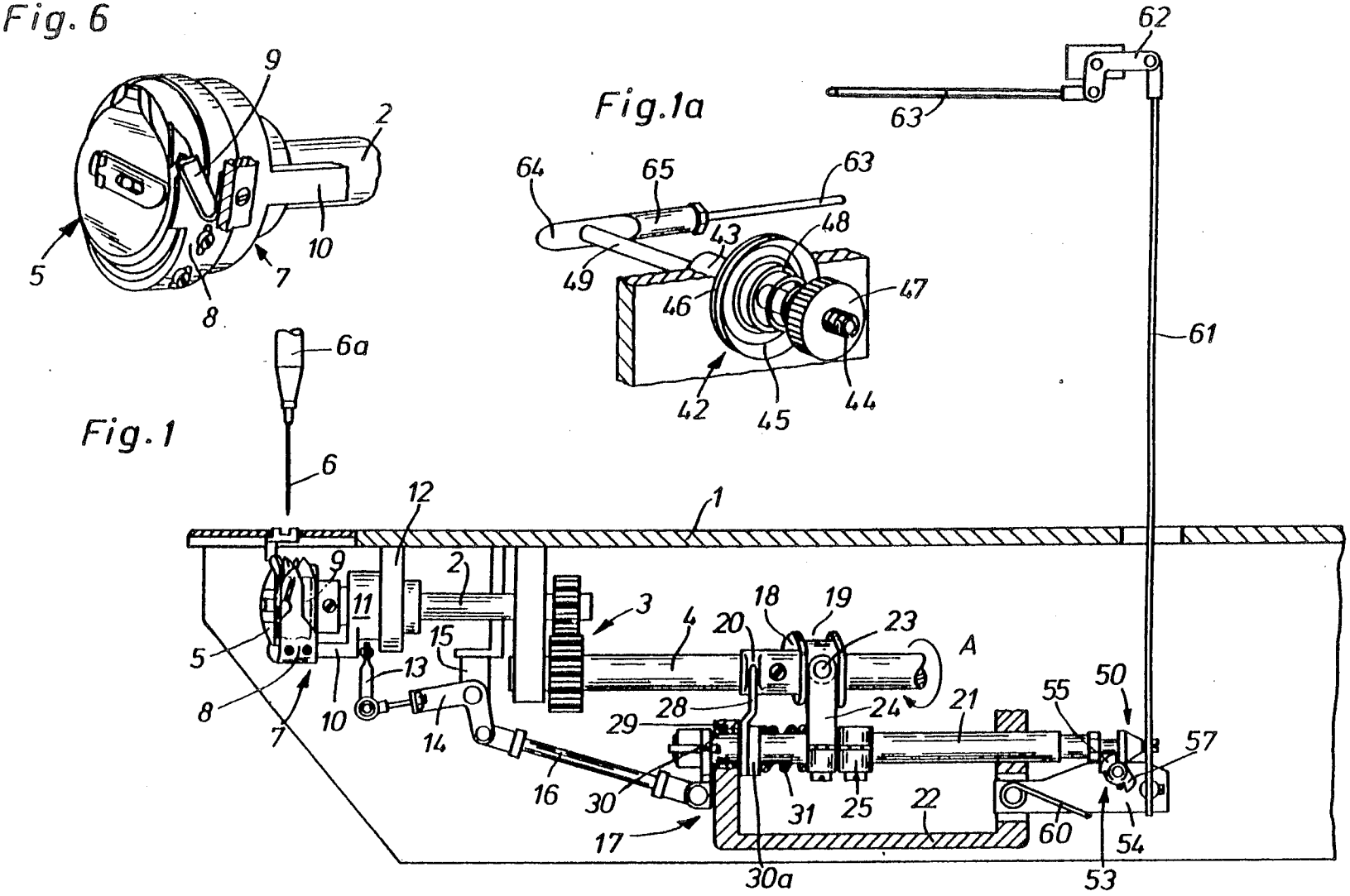
FIG. 1 is a partially cut-away sectional view showing a sewing machine with a control of the thread cutting device and of the thread tensioning mechanism according to the invention.
FIG. 1*a* is a sectional view showing the thread tensioning mechanism in detail.
FIG. 6 is a schematic representation of the shuttle together with the cut-off device.

FIG. 1 shows the base plate 1 of a sewing machine, under which the horizontal shuttle drive shaft 2 is mounted. The shaft is driven by a lower main shaft 4 via a step-up gear 3. The shuttle 5 is fastened at the front end of the shuttle drive shaft 2. It cooperates with the needle 6 that can be moved up and down and fastened in a needle bar 6*a* which is only schematically indicated. A thread cutting device 7, whose design and mode of operation are described in U.S. Pat. No. 3,173,392, is arranged under the base plate 1. The thread cutting device 7 has a thread catcher 8, which is arranged coaxially with the shuttle 5 and cooperates with a cutting blade 9 fastened on the lower side of the base plate 1. The thread catcher 8 is fastened on a supporting arm 10 which is connected to a ring 11 that loosely surrounds the shuttle drive shaft 2. The ring is secured in the axial direction and is mounted freely rotatably in loop 12 that is fastened under the base plate 1. A connecting rod 13 is hinged to the supporting arm 10, and the connecting rod 13 is connected to an arm of an angle lever 14 which is supported by a bearing block 15 that forms an integral part of the housing. The other arm of the angle lever 14 is connected to a drive mechanism 17 for the thread catcher 8 via a bar 16.

Figure 2:
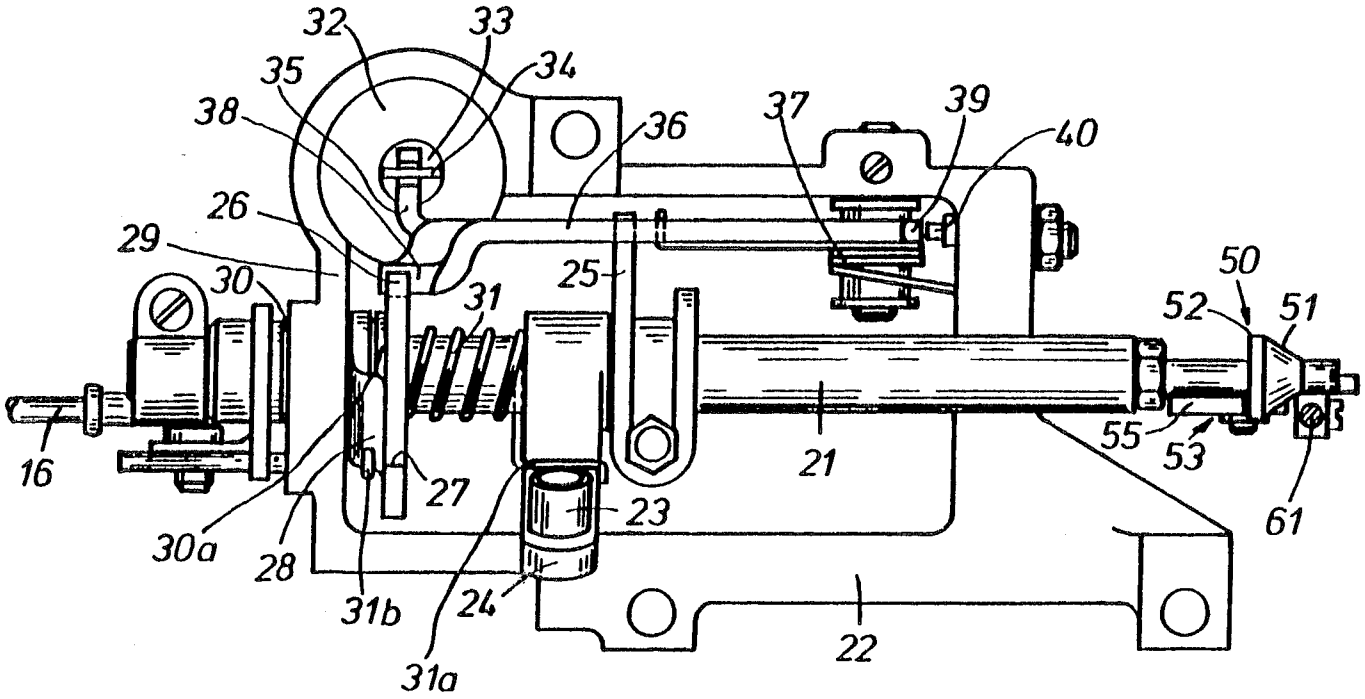
FIG. 2 is a top view of part of the drive of the thread cutting and tensioning device shown in FIG. 1.

To drive the thread catcher 8, a cam 18, which has a control groove 19 as well as a control segment 20, is fastened on the main shaft 4. A drive mechanism 21, designed as an axially displaceable shaft, is mounted in a support 22 fastened under the base plate 1 in parallel to the main shaft 4 (cf. FIG. 2). A control lever 24, provided with a roller pin 23 as well as a releasing lever 25, is fastened on the drive mechanism 21. A pawl 28 equipped with a locking lug 26 and a stop 27 is loosely mounted on a sleeve 30 fastened in a side wall 29 of the support 22 and is secured against axial displacement by the side wall 29 of the support 22 as well as by an end flange 30*a* of the sleeve 30. A spring 31 wound around and is supported by the drive mechanism 21, which abuts the control lever 24 at one end 3*a* and is supported by the pawl 28 at the other end 3*b* causes the pawl to swivel in the direction toward the control segment 20 of the cam 18 and the roller pin 23 out of the control groove 19. At the same time, the spring 31 acts as a compression spring and displaces the drive mechanism 21 into its right-hand end position, shown in FIG. 1, in which the roller pin 23 is opposite the control groove 19 when the sewing machine is in the lowered needle position.

An electromagnet 32, whose armature 33 is connected to an arm 35 of a starting lever 36 via an eye 34, is fastened in the support 22. The starting lever is mounted in the support 22 and is pivoted upward by a torsion spring 37 until a pivoted-down projection 38 comes into contact with the locking lug 26 of the pawl 28 or—with the pawl in the pivoted-down position—until a stop 39 comes into contact with a setscrew 40 fastened adjustably in the support 22.

Before the threads are cut, they must be pulled out over a length sufficient for the subsequent stitch formation. This takes place with the needle thread tensioning mechanism released. The thread tensioning mechanism 42 (FIG. 1*a*) for the needle thread consists of a sleeve 43 with a longitudinally slotted setscrew 44 fastened in the machine housing, wherein tensioning disks 45, 46 are arranged on the setscrew and the disks are compressed by a tension spring 48 adjustable by means of a knurled nut 47 in order to exert a decelerating force on the needle thread. A releasing pin 49 is arranged in the sleeve 43 longitudinally displaceably, by means of which the tensioning disk 45 can be lifted off from the tensioning disk 46 against the action of the tension spring 4 in order to open the thread tensioning mechanism 42.

A cam 50, whose surface is designed as a cam curve having a curve section 51 rising in the shape of a wedge at one end and a straight and then radially falling curve section 52 at the other end, is used to actuate the releasing pin 49, and consequently to release the thread tensioning mechanism 42. A one-way coupling 53, which is arranged on a lever arm 54 mounted on the support 22, cooperates with the cam 50. The one-way coupling 53 consists of a segment-shaped lever 55, which is mounted pivotably on lever arm 54 and cooperates with the cam 50, as well as a stop 57, which is in contact with a pin 59 fastened in the lever arm 54 under the action of a torsion spring 58.

The lever arm 54 is rotated by a torsion spring 60 until a lateral contact surface 54*a* or the one-way coupling 53 comes into contact with the cam 50. The torque exerted by the torsion spring 60 considerably exceeds the torque exerted by the torsion spring 58. The lever arm 54 is connected to an angle lever 62 mounted on the machine housing via a bar 61. A push rod 63, which carries at its front end a releasing member 65 provided with an oblique surface 64 (FIG. 1*a*), is hinged to the angle lever.

Figure 3:
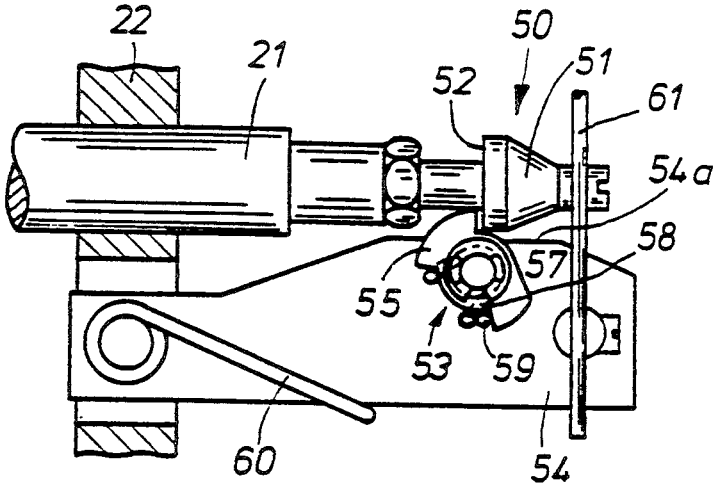
FIGS. 3 through 5 show various positions of the cam and of the one-way coupling for controlling the thread tension according to the invention.
Figure 4:
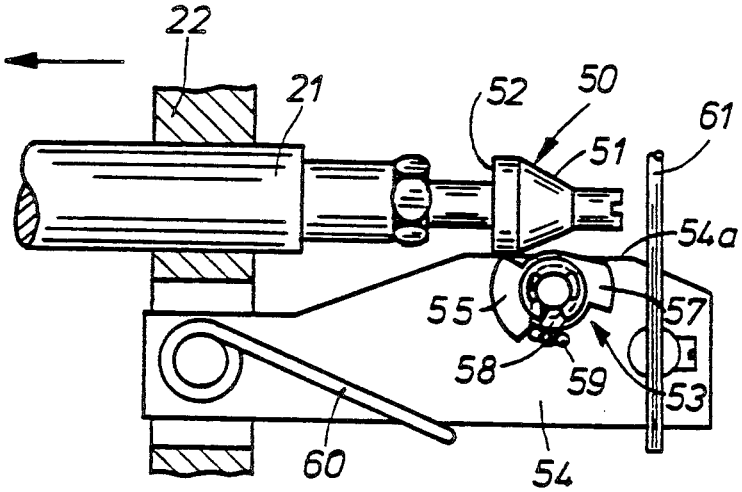

Assuming that the sewing machine is running and the roller pin 23 is in its position outside the cam groove 19 of the cam 18 rotating together with the main shaft 4, the thread catcher 8 with its drive member 21 is in its starting position, and the thread tensioning mechanism 42 for the needle thread is closed, the device operates as follows: At the end of the seam, the sewing machine is briefly stopped by a needle positioning device in the lowered needle position, which is the starting position for thread cutting. The cam groove 19 in the cam 18 now assumes a position in which the roller pin 23 on the control lever 24 can be moved into the cam groove 19 by a single swiveling movement. The cam 50 and the one-way coupling 53 are in the position shown in FIG. 3, in which the thread tensioning mechanism 42 is closed.

By actuating a switch while depressing the pedal of the sewing machine for the reverse direction, the electromagnet 32 is briefly energized and the drive motor of the sewing machine is turned on immediately thereafter. The starting lever 36 is pulled down by the armature 33 of the electromagnet 32 and it pushes the roller pin 23 into the cam groove 19 via the releasing lever 25 and the control lever 24. At the same time, the spring 31 pivots the pawl 28, whose locking lug 26 lies against the projection 38 on the starting lever 36 and thus locks the position of the roller pin 23 pushed into the cam groove 19.

During the subsequent revolution of the main shaft 4 in the direction of arrow A, which is necessary for the thread cutting, the cam groove 19, extending in the axial direction, displaces the drive mechanism 21—via the control lever 24—from its resting position to the left, corresponding to a first section of the cam groove 19. The drive mechanism 21 now moves the thread catcher 8 via the angle lever 14 and the connecting rod 13 and into the widened needle thread loop caught by the shuttle 5 and thus catches the leg of the needle thread loop leading to the fabric to be sewn, as well as the shuttle thread, in the known manner.

During its displacement to the left, the cam section 52 hits the lever 55 and rotates same against the force of the torsion spring 58, so that the lever arm 54 remains in its resting position determined by the contact between the contact surface 54*a* and the cam section 52 during the displacement of the drive mechanism 21 to the left, and while the wedge-shaped curve section 51 passes by, the lever 55 again returns into its resting position, in which it is in contact with the pin 59.

Figure 5:
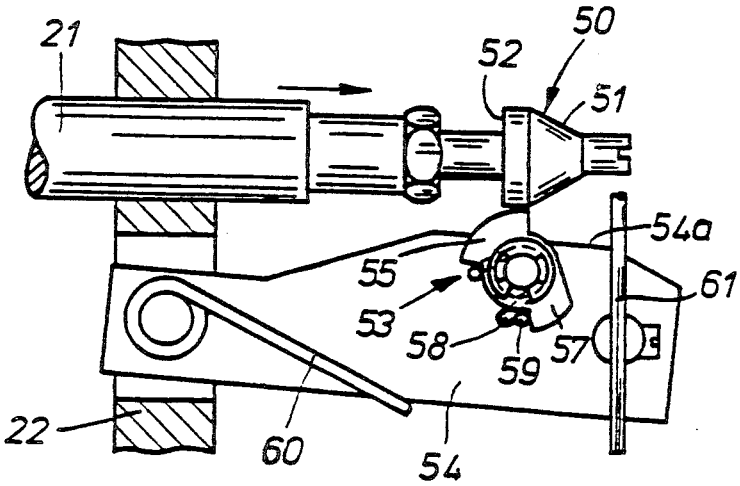

After the loop of the needle thread has fallen off from the shuttle 5, the drive mechanism 21 is moved to the right as a consequence of the curved design of the cam groove 19 (FIG. 5). The wedge-shaped cam section 51 of the cam 50 now moves toward the lever 55 of the one-way coupling 53 and thus pivots the lever arm 54, which releases the thread tensioning mechanism 42 for the needle thread via the bar 51, the angle lever 62 and the push rod 63 in such a way that the releasing pin 49 is axially displaced by the oblique surface 64 of the releasing member 65, as a result of which the tensioning disk 45 is lifted off from the tensioning disk 46 against the force of the tension spring 48.

At the same time, the thread catcher 8 pulls thread from the shuttle thread reserve and the needle thread reserve due to the movement of the drive mechanism 21 to the right until the cutting blade 9 fastened on the lower side of the base plate 1 cuts off both threads shortly before the end of this movement.

Immediately thereafter, the cam section 52 of the cam 50 moves past the lever 55 of the one-way coupling 53, and the lever 55 can drop in behind the cam section 52 under the pressure of the torsion spring 60, so that the lever arm 54 can come into contact with its lateral contact surface 54*a* with the axially parallel surface of the cam section 52 of the cam 50. This dropping off of the lever 55 from the cam section 52 brings about immediate closure of the thread tensioning mechanism 42 via the tensioning release linkage.

During the further residual rotation of the main shaft 4 until the sewing machine is turned off in the raised needle position, the segment 20 pivots the pawl 28 over the stop 27, so that the locking lug 26 again releases the starting lever 36. The starting lever is pivoted upward by the torsion spring 37 until it comes into contact with the projection 38 at pin 40. As a result, the spring 31 is able to push the control lever 24 away from the cam 18, so that the roller pin 23 is lifted out of the cam groove 19. The sewing machine will then be stopped with the thread lever in the raised position and is ready for the next sewing operation.

While a specific embodiment of the invention has been shown and described in detail to illustrate the application of the principles of the invention, it will be understood that the invention may be embodied otherwise without departing from such principles.

We claim:

1. A thread cutting arrangement for sewing machines, comprising: an axially moveable drive mechanism; thread catcher means, actuated by said axially moveable drive mechanism, said thread catcher means performing a first movement step catching a needle thread and a shuttle thread, and a second movement step, having a direction which is opposite to said first movement step, in which the needle thread and the shuttle thread are pulled out and fed to a stationary cutting blade; a thread tensioning mechanism for tensioning the needle thread; releasing member means for disengaging the thread tensioning mechanism to open the thread tensioning mechanism during the thread pull operation; a cam arrangement rigidly attached to the drive mechanism for actuating the releasing mechanism; a one-way coupling for the releasing member, acting during the second movement step of the drive mechanism, said one-way coupling being connected between the drive mechanism and a linkage connected to the releasing member.

2. A thread cutting device according to claim 1, wherein said one-way coupling arrangement includes a lever yielding in one direction, which pivots during the first movement step of the drive mechanism and remains rigid during the second movement step of the drive mechanism.

3. A thread cutting arrangement according to claim 1, wherein said cam is limited by a cam section rising in wedge-shaped manner at one end and by a radially dropping cam section at another end.

* * * * *